United States Patent [19]

Holmgren et al.

[11] 4,383,151

[45] May 10, 1983

[54] OPERATING MECHANISM FOR A FLUID BLAST CIRCUIT INTERRUPTER

[75] Inventors: Nils Holmgren, Greendale; Charles J. Knotek, Racine, both of Wis.

[73] Assignee: McGraw-Edison Company, Rolling Meadows, Ill.

[21] Appl. No.: 148,728

[22] Filed: May 12, 1980

[51] Int. Cl.[3] ..... H01H 33/42; H01H 33/54

[52] U.S. Cl. ..... 200/148 R; 200/148 B; 200/148 F

[58] Field of Search ..... 200/148 R, 148 B, 148 D, 200/148 F

[56] References Cited

U.S. PATENT DOCUMENTS 3,956,605 5/1976 Roidt et al. ..... 200/148 B

*Primary Examiner*—Robert S. Macon

*Attorney, Agent, or Firm*—Jon Carl Gealow; Ronald LaPorte; Thomas E. McDonald

[57] ABSTRACT

An operating mechanism for a fluid blast circuit interrupter which is actuated by a single drive shaft and includes a toggle linkage for opening and closing the breaker contacts, and a cam and rachet assembly for opening and closing a gas supply valve. Upon initiation of an opening or closing operation, the cam is coupled to the drive shaft and rotated to open a normally closed, spring loaded, gas valve before the interrupter contacts are opened or closed, and to charge a cam return spring. After the interrupter contacts are fully opened or closed, the cam is disengaged from the drive shaft and returned to its neutral position by its return spring to allow the gas valve to reclose.

13 Claims, 10 Drawing Figures

OPERATING MECHANISM FOR A FLUID BLAST CIRCUIT INTERRUPTER

BACKGROUND OF THE INVENTION

1. Field of the Invention

This invention relates generally to electrical switching apparatus, and more particularly, to an operating mechanism for a fluid blast circuit interrupter.

2. Description of the Prior Art

Conventionally, during the opening operation of a fluid blast circuit interrupter, the arc established between the separating breaker contacts of the interrupter is extinguished by a blast of high pressure, arc-extinguishing gas, which, when directed orthogonally to the arc for elongation and cooling thereof, transforms the conductive arcing path into an insulating medium as the alternating current passes through current zero. Generally, such circuit interrupters include a high pressure gas valve for supplying the arc-extinguishing gas from a high pressure gas reservoir, which valve must be operated in synchronism with the breaker contacts. For example, U.S. Pat. No. 3,956,605, issued May 11, 1976, to Roidt et al, discloses a fluid blast circuit interrupter in which the opening of the high pressure gas valve is coordinated with the opening of the interrupter contacts by using a rotatable cam plate to individually actuate both the high pressure valve and the interrupter contacts in a variable and predetermined manner.

SUMMARY OF THE INVENTION

It is an object of the present invention to provide an operating mechanism for a fluid blast circuit interrupter, which not only independently opens the high pressure gas supply valve in variable, predetermined manner, but also quickly closes the gas supply valve after current interruption is completed to conserve the high pressure gas supply not required for interruption.

It is a further object of the invention to disclose an operating mechanism for a fluid blast circuit interrupter which, during the closing operation of the circuit interrupter, opens the gas supply valve in a variable, predetermined manner to provide a flow of gas through the closing interrupter breaker contacts to eliminate arcing between the contacts before they are fully closed, and to immediately and quickly close the gas supply valve when the interrupter contacts are fully closed.

The present invention comprises an operating mechanism for a fluid blast circuit interrupter which includes at least one set of interrupter contacts, a conduit for directing the flow of pressurized arc-quenching gas against the arc formed between the interrupter contacts when they are open, and a gas supply valve connecting the conduit to a high pressure reservoir of the arc-quenching gas.

One of the interrupter contacts is a movable contact which is disposed on one end of a contact operating shaft that is slideably mounted to the circuit interrupted frame for movement along its longitudinal axis between closed and open positions. The opposite end of the contact operating shaft is pivotally connected to one end of a toggle connecting link. The opposite end of the toggle connecting link is pivotally connected to one end of a center crank carried by a center drive shaft which is rotatable between closed and open positions corresponding to the closed and open positions of the movable contact. The center crank and toggle connecting link comprise a contact operating toggle assembly.

When the center drive shaft is moved from its open position to its closed position, the center crank and the toggle connecting link are moved into their fully-extended positions and the contact operating shaft is moved along its longitudinal axis away from the center drive shaft to its fully closed position. In response thereto, the movable contact carried by the contact operating shaft abuts against the other, stationary interrupter contact. Similarly, when the center drive shaft is rotated in the opposite direction, to its open position, the toggle linkage is retracted and the contact operating shaft is moved along its longitudinal axis toward the center drive shaft to open the interrupter contacts. At least one of these contacts is spring loaded so that the contacts close before the center drive shaft reaches its closed position.

A valve operating cam, which is pivotally mounted on the center drive shaft, is connected to the circuit interrupter stationary structure by a cam positioning spring which exerts a force on the valve operating cam when it is rotated about the center drive shaft in either a clockwise or counter-clockwise direction. The purpose of the spring is, to return the valve operating cam to a neutral position at such time the cam positioning spring is unloaded. The movable element of the gas supply valve is disposed on one end of a valve actuating rod. The rod is slideably mounted on the circuit interrupter support structure for movement along the longitudinal axis of the rod between an open and a closed position. A valve closing spring disposed between the valve actuating rod and the stationary element of the gas supply valve, exerts a force on the valve actuating rod to maintain the gas supply valve in its closed position. A double ended lever, pivotally mounted to the circuit interrupter support structure, has one end which is coupled to the opposite end of the valve actuating rod by a connecting link. The link is pivotally connected to the lever at one end and to the valve actuating rod at the other end. A cam follower, pivotally mounted on the other end of the double ended lever, is held in contact with a peripheral surface of the valve operating cam by the force exerted on it by the valve closing spring through the valve actuating rod, the connecting link and the double ended lever. The periphery of the valve operating cam on which the cam follower rolls is shaped such that when the valve operating cam is in its neutral position, the gas supply valve is fully closed. As the valve operating cam is rotated in either direction from its neutral position, it acts on the cam follower to rotate the double ended lever and open the gas supply valve. Thus, the valve closing spring exerts a force on the valve operating cam through the cam follower assembly to maintain the valve operating cam in its neutral position.

An opening pawl pivotally mounted on one end of the center crank, and a closing pawl pivotally mounted on the opposite end of the center crank, are acted upon by respective torsion springs connected between the pawls and the center crank to hold the pawls against a collar portion of the valve operating cam. When the center drive shaft is in its closed position, and the valve operating cam is in its neutral position, the opening pawl is in contact with a first set of ratchet teeth defined by the periphery of the collar portion of the valve operating cam. The ratchet teeth are shaped to engage the opening pawl during rotation of the center drive shaft toward its opening direction. When the center drive shaft is in its open position, and the valve operating cam in its neutral position, the closing pawl is held in contact with a second set of ratchet teeth defined by the periphery of the collar portion of the valve operating cam, which teeth set is shaped to engage the closing pawl when the center drive shaft is rotated toward its closing direction. A pawl trip pin is disposed on the circuit interrupter support structure relative to the pawls so that when the center drive shaft is rotated to its open position, the end of the opening pawl will engage the pawl trip pin and be rotated away from the collar portion of the valve operating cam. When the center drive shaft is rotated to its closed position, the end of the closing pawl will engage the pawl trip pin and be rotated away from the collar portion of the valve operating cam.

When the circuit interrupter is in its closed position, the aforementioned contact operating toggle assembly, comprising the center crank and the toggle connecting link, is in its fully extended toggle position to maintain the movable interrupter breaker contact in spring-loaded engagement with the other interrupter breaker contact. The valve operating cam is held in its neutral position by the valve closing spring, which also maintain the gas supply valve closed. When the center drive shaft is rotated toward its opening direction, the valve operating cam is engaged with the center crank by the opening pawl and rotated with the center crank to open the gas supply valve, through the cam follower assembly, before the breaker contacts part. As the center drive shaft approaches its open position, the opening pawl disengages the collar portion of the valve operating cam to allow the cam positioning spring and the valve closing spring to quickly return the valve operating cam to its neutral position and close the gas supply valve. When the circuit interrupter is in its open position, and the center drive shaft is rotated toward its closing direction, the valve operating cam is engaged with the crank arm by the closing pawl and rotated with it to open the gas supply valve as the interrupter contact is moved toward the other interrupting contact by the rotation of the center crank, thereby to prevent arcing between the contacts before they are fully closed. As the center drive shaft approaches its closed position, the closing pawl engages the pawl trip pin and is rotated outwardly from the collar portion of the valve operating cam to disengage the cam and the center crank and allow the cam to be quickly returned to its neutral position by the cam positioning spring and the valve closing spring, thereby to quickly close the gas supply valve after the interrupter breaker contacts have closed.

The above objects and other objects of the present invention will become more apparent to those skilled in the art from the following more detailed description of the drawings herein.

DESCRIPTION OF A PREFERRED EMBODIMENT

Figure 1:
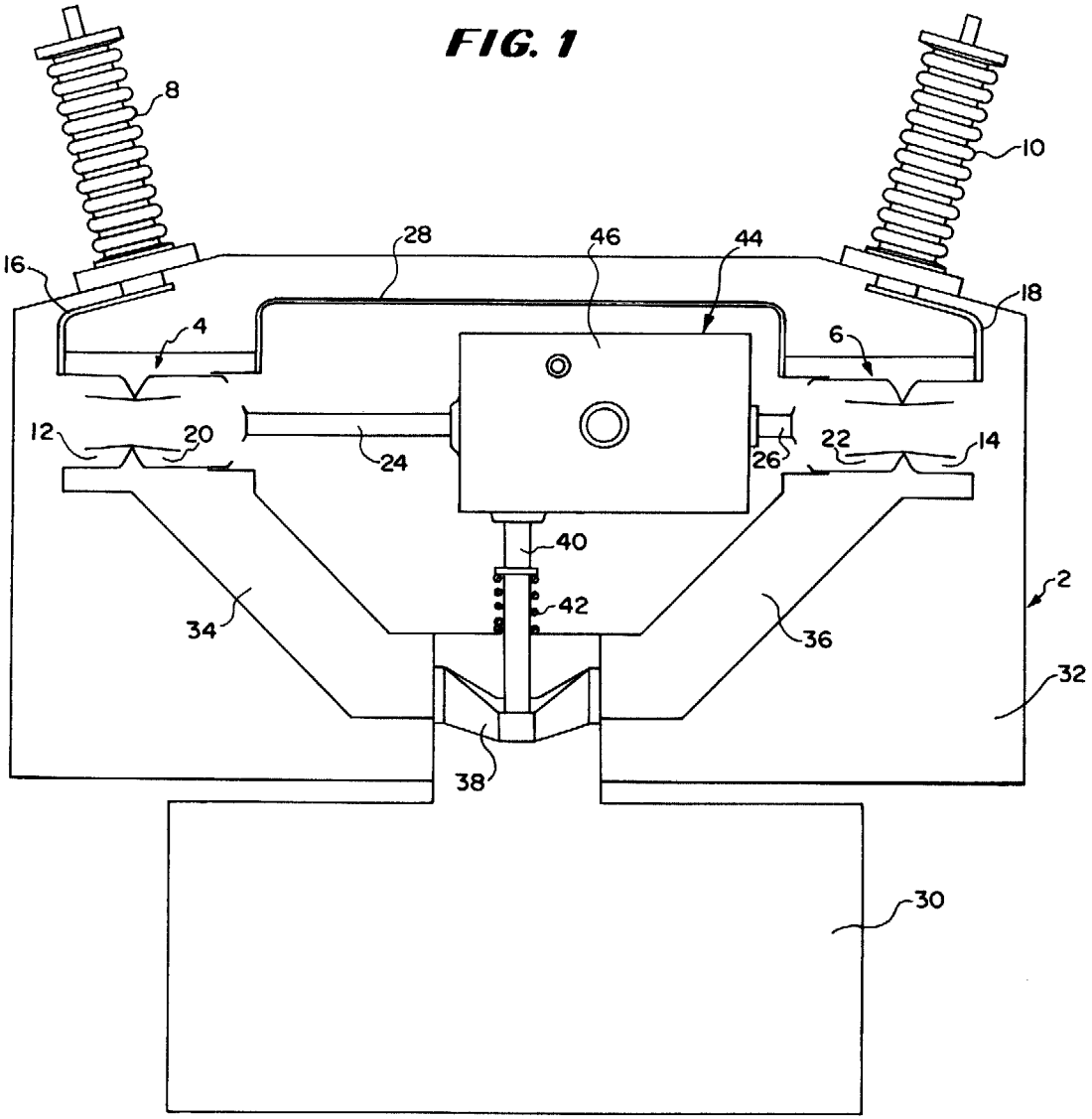
FIGS. 1, 2 and 3, are cross-sectional side views of a fluid blast circuit interrupter, including the operating mechanism described herein, illustrating the position of the interrupter contacts and the fluid supply valve with the circuit interrupter in respective closed, intermediate, and opened positions.
Figure 2:
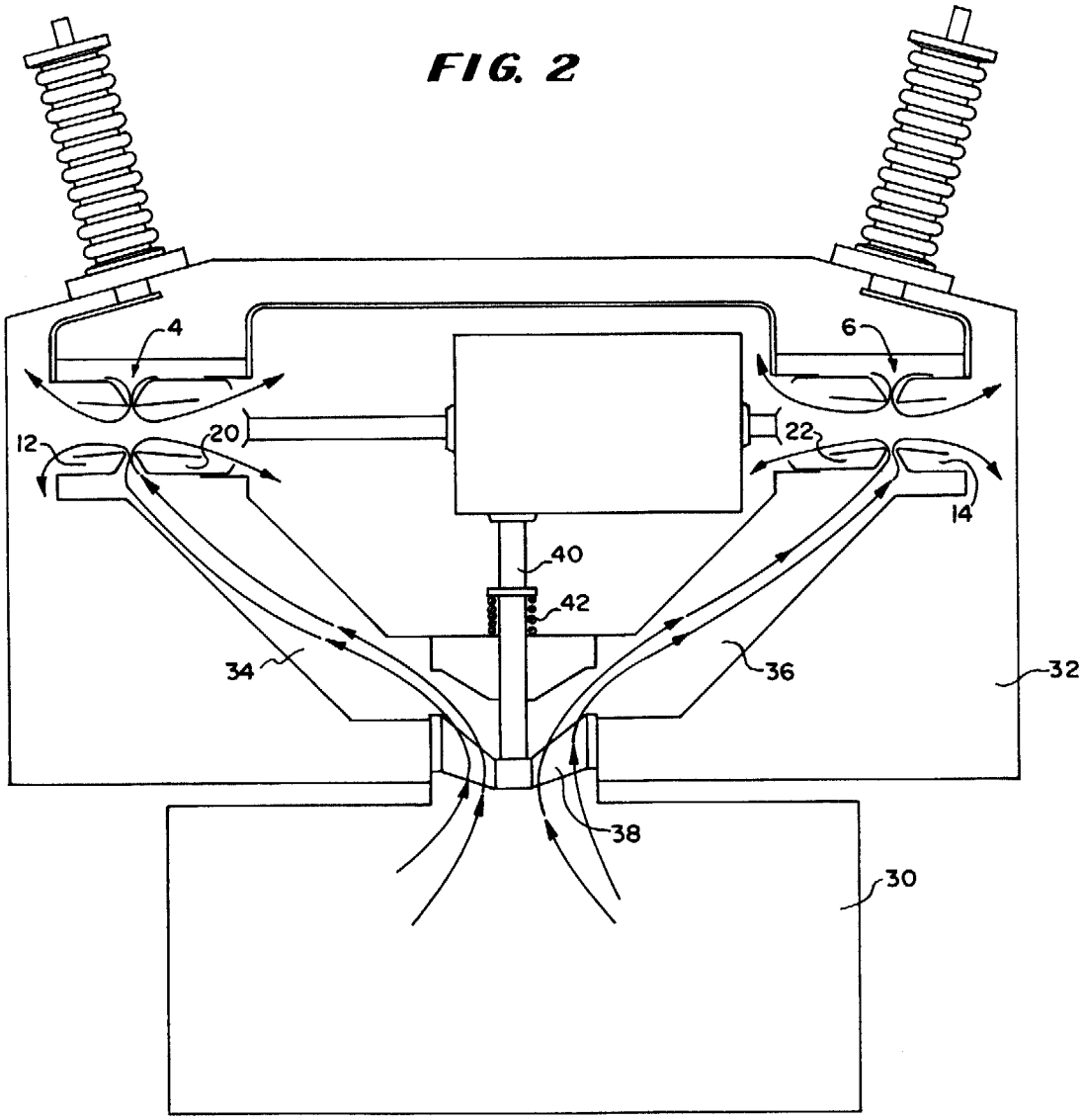
Figure 3:
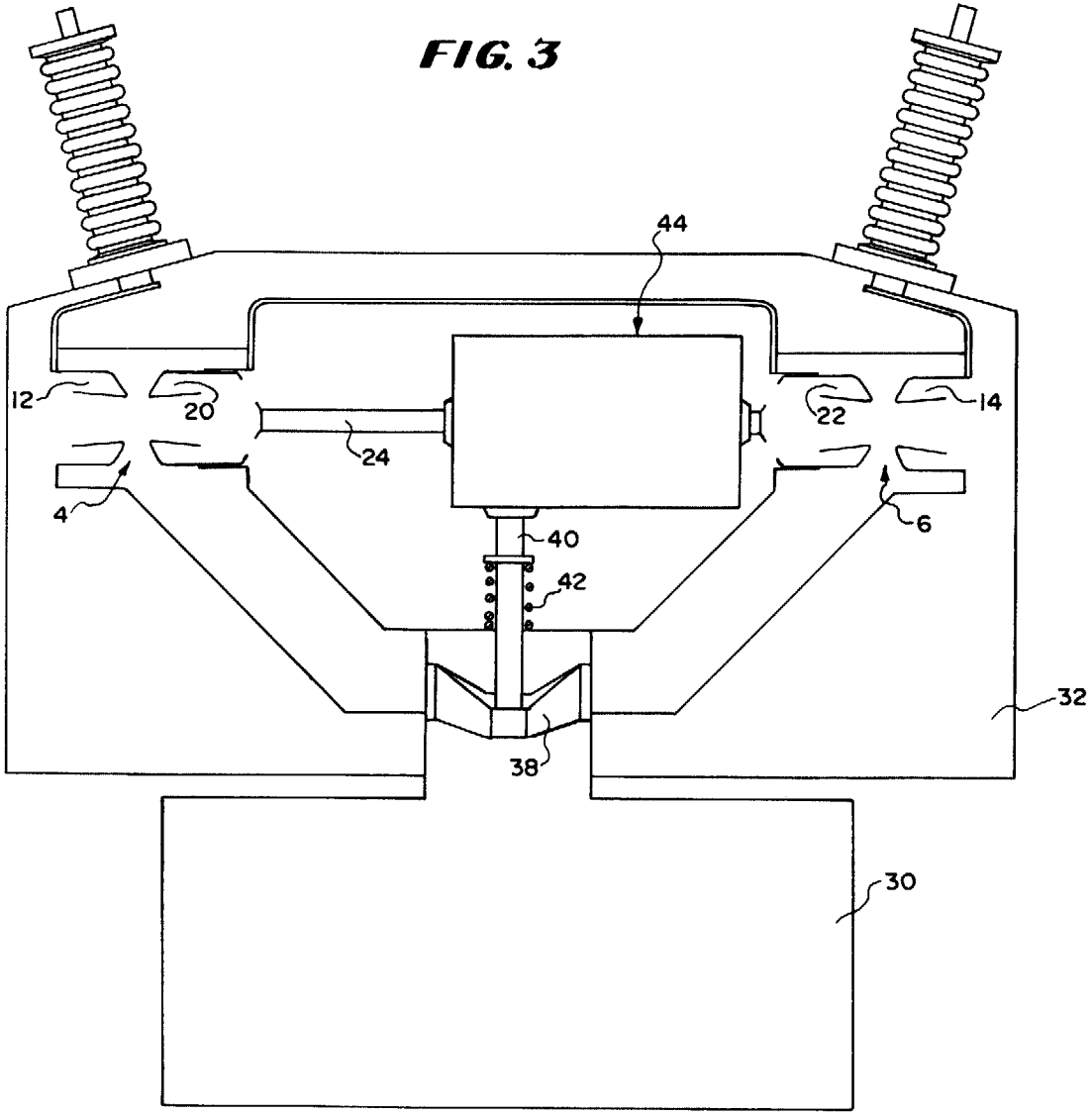

Referring now to FIGS. 1–3, each phase circuit of a circuit interrupter 2 includes two interrupting modules 4, 6, electrically connected in series between a source bushing terminal 8 and a load bushing terminal 10. Each of interrupting modules 4, 6, includes a respective, toroidal stationary contact 12, 14 which is connected to a corresponding one of the bushing terminals 8, 10, by a respective terminal bus 16, 18. Each of the interrupter modules 4, 6, also includes a torodial, movable contact 20, 22, shown in its closed position in FIG. 1 and in its fully open position in FIG. 3. Each movable contact 20, 22 is disposed on a respective, electrically-insulating, contact operating shaft 24, 26, and is connected electrically to the other movable contact by an interconnecting bus 28. When the circuit interrupter 2 is closed as shown in FIG. 1, current is permitted to flow through the current path comprising source bushing terminal 8, bus 16, closed contacts 12, 20, interconnecting bus 28, closed contacts 14, 22, bus 18 and load terminal bushing 10.

The circuit interrupter 2 also includes a high pressure gas reservoir 30, and a low pressure gas reservoir 32 defined by the space between the inner surfaces of the interrupter contacts 12, 14, 20, and 22. Each of interrupter modules 4, 6, is disposed within a respective electrically-insulating plenum 34, 36, each of which is connected through a high pressure valve 38 to the high pressure reservoir 30 when the high pressure valve 38 is in its open position as shown in FIG. 2. High pressure valve 38 is disposed on a valve actuating rod 40, and is normally held in its closed position as shown in FIGS. 1 or 3, by a valve closing spring 42 disposed between the valve actuating rod 40 and the casing of the high pressure valve 38. Valve actuating rod 40 and the two contact operating shafts 24, 26, are connected to, and actuated by, the circuit interrupter operating mechanism 44, disposed within a stationary supporting structure 46 of the circuit interrupter 2.

Figure 4:
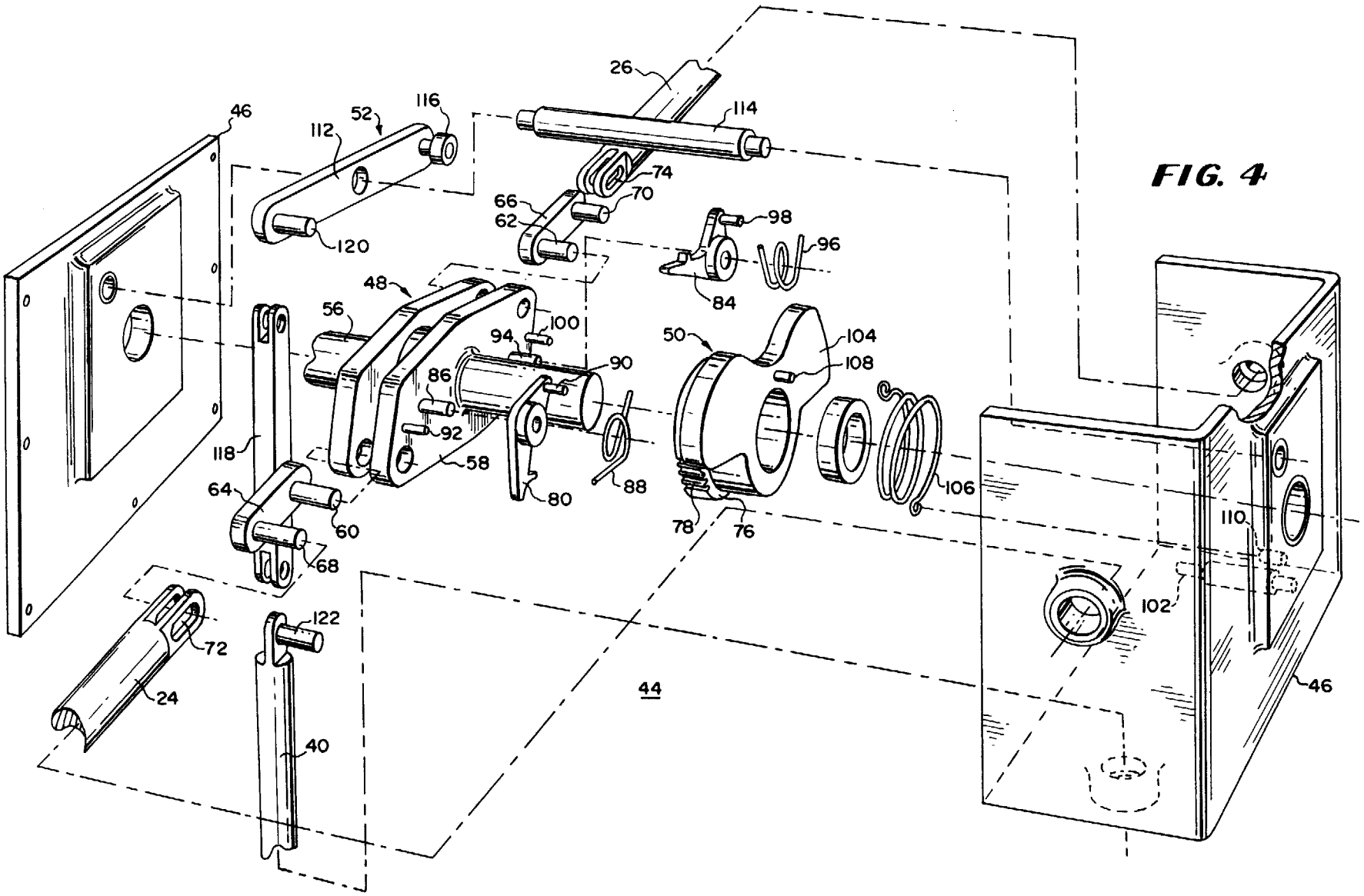
FIG. 4 is a perspective, exploded view of the circuit interrupter operating mechanism described herein.
Figure 5:
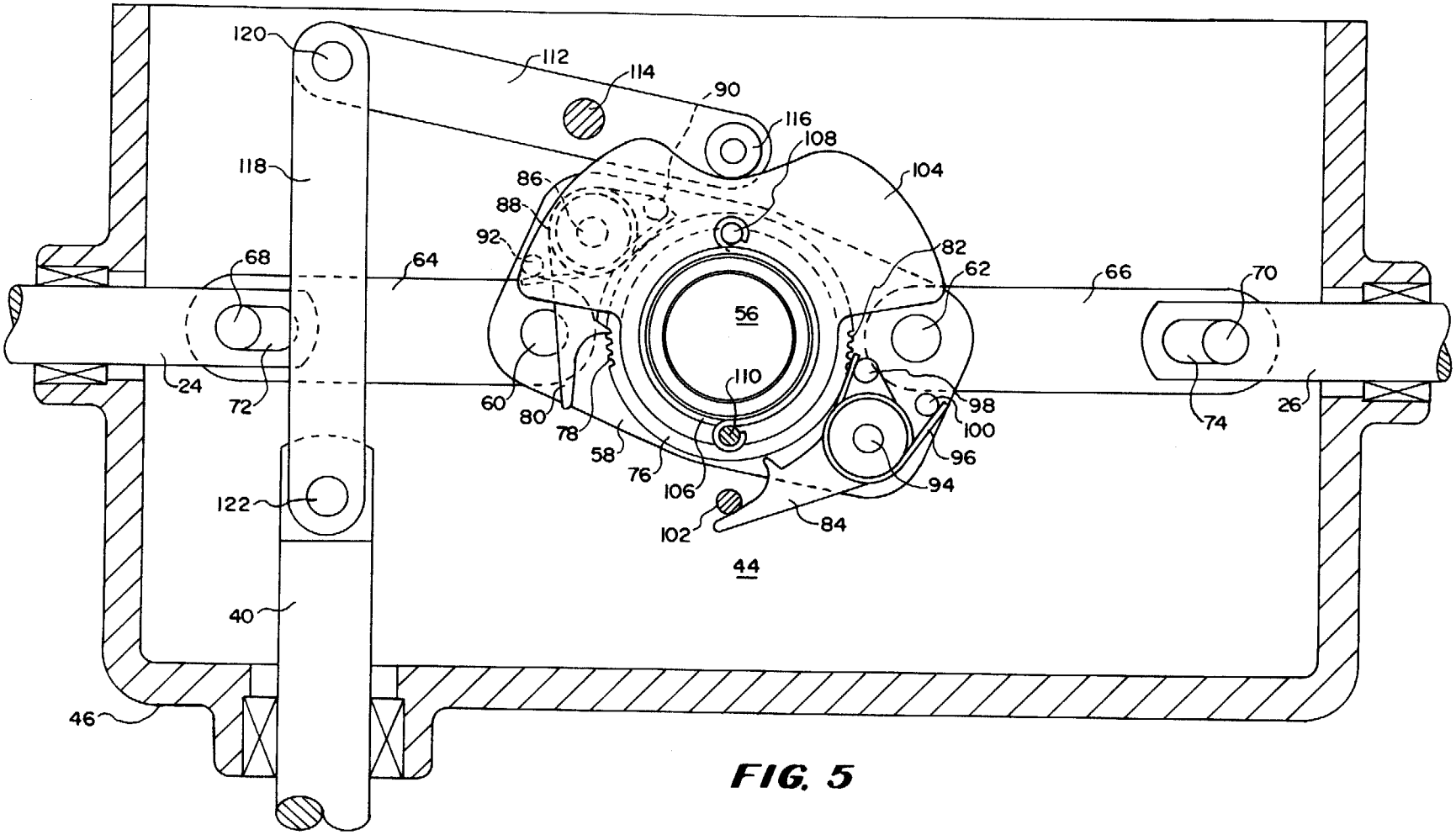
FIGS. 5 through 10 are respective cross-sectional views of the circuit interrupter operating mechanism, taken in a plane orthogonal to the axis of the center drive shaft of this mechanism, illustrating respective positions of the various elements of the operating mechanism during opening and closing operations thereof.

Referring now to FIGS. 4 and 5, the circuit interrupter mechanism 44 includes a contact operating toggle assembly 48, a valve operating cam-ratchet assembly 50, and a cam follower assembly 52.

Contact operating toggle assembly 48 includes a center drive shaft 56, a center crank member 58 carried by the center drive shaft 56, two pivot pins 60, 62 disposed at opposite ends of the center crank 58, and two toggle connecting links 64, 66, each having one end pivotally connected to center crank 58 by a respective one of the pivot pins 60, 62. The opposite end of each of toggle connecting links 64, 66, carries a respective pivot pin 68, 70, for pivotally connecting each toggle connecting link 64, 66, to a respective contact operating shaft 24, 26 . The end of each contact operating shaft 24, 26, adjacent the circuit breaker operating mechanism 44 is slotted to receive the end of a respective connecting link 64, 66 carrying the pivot pin 68, 70. The side portions of each contact operating shaft 24, 26, defining the slot for receiving the respective connecting link 64, 66, also defines elongated transverse openings 72, 74 therethrough for receiving a respective pivot pin 68, 70 of the connecting links 64, 66. Spring elements (not shown) for spring loading the contacts of each interrupting module 4, 6 can be located at any point in the mechanical linkage between the toggle connecting link 64, 66 and associated movable contacts 20, 22. Alternatively, the contacts 12, 14 can be spring loaded. When the circuit interrupter 2 is closed, the spring elements exert a force against each contact operating shaft 24, 26 to position the inner end of each elongated transverse opening 72, 74 against a respective pivot pin 68, 70 extending therethrough, as shown in FIG. 5.

The cam-ratchet assembly 50 includes a circular ratchet member 76 pivotal about the center drive shaft 56. The outer periphery of ratchet member 76 defines a first set of ratchet teeth 78, for engagement with a spring-loaded opening pawl 80 during counter-clockwise rotation of the center drive shaft 56, and an opposite set of ratchet teeth 82 for engagement with a spring-loaded closing pawal 84 during clockwise rotation of the center drive shaft 56. The opening pawl 80 is pivotal about a pivot shaft 86 disposed on one side of the center crank 58. A torsion spring 88, is disposed about the pivot shaft 86. One end of the torsion spring is held by a spring retaining pin 90 carried by the opening pawl 80. The opposite end of spring 88 is held by another spring retaining pin 92 carried by the center crank member 58. Torsion spring 88 exerts a force on the opening pawl 80 to hold it against ratchet member 76. Similarly, closing pawl 84 is disposed on the opposite side of the center crank member 58. A second torsion spring 96, has one end held by a spring retaining pin 98 disposed on closing pawl 84 and the opposite end held by a spring retaining pin 100 disposed on the center crank member 58. Torsion spring 96 exerts a force on closing pawl 84 to hold it against the ratchet member 76. A stationary pawl trip pin 102, held by the mechanism supporting structure 46, selectively engages the free end of either the opening pawl 80 or the closing pawl 84 to disengage a respective pawl from the ratchet member 76 when the center crank member 58 is rotated. Thus, when center drive shaft 56 and center crank 58 are rotated in a counter-clockwise direction, closing pawl 84 rides over ratchet teeth 82. At the same time opening pawl 80 engages ratchet teeth 78 to couple ratchet member 76 to center crank 58, causing ratchet member 76 to rotate in a counter-clockwise direction with center crank 58 until the free end of opening pawl 80 rides up and over stationary pawl trip pin 102, thereby to disengage opening pawl 80 and ratchet member 76. Opening pawl 80 is positioned on the center crank 76 relative to the stationary pawl trip pin 102 to permit pawl trip pin 102 to disengage opening pawl 80 from the ratchet member 76 when the center crank 58 and the movable contacts 20, 22, are disposed in their fully open position. In a similar manner, when center drive shaft 56 and center crank 58 are rotated in a clockwise direction, opening pawl 80 rides over associated ratchet teeth 78, while closing pawl 84 engages associated ratchet teeth 82 to couple ratchet member 76 to the center crank 58 and cause ratchet member 76 to rotate in a clockwise direction with center crank 58 until the free end of closing pawl 84 rides up and over stationary pawl trip pin 102 to rotate closing pawl 84 about its pivot shaft 94 and disengage closing pawl 84 and ratchet member 76. Closing pawl 84 is positioned on the center crank 76 relative to pawl trip pin 102 so that the pawl trip pin will disengage closing pawl 84 and ratchet member 76 when the center crank 58 and movable contacts 20, 22 are disposed in their fully closed position.

A valve operating cam 104 is integrally formed with ratchet member 76, to be rotated with center crank 58 whenever opening pawl 80 or closing pawl 84 is engaged by ratchet member 76 during rotation of center drive shaft 56 and center crank 58. A torsion spring 106, disposed about center drive shaft 56, has one end held by a spring retaining pin 108 disposed on cam 104 and an opposite end held by a stationary spring retaining pin 110 disposed on mechanism supported structure 46. Torsion spring 106 tends to position valve operating cam 104 and ratchet member 76 in a neutral position corresponding to the unloaded position of torsion spring 106. When center crank 58 is in its fully extended, closed position and ratchet member 76 is in its neutral position, opening pawl 80 is disposed adjacent to, and in contact with, one of ratchet teeth 78. Similarly when center crank 58 is in its fully open position and ratchet member 76 is in its neutral position, closing pawl 84 is disposed adjacent to, and in contact with, one of ratchet teeth 82. When ratchet member 76 and valve operating cam 104 are in their neutral position, and center crank 58 is rotated counter-clockwise from its fully extended, closed position, opening pawl 80 will immediately engage ratchet member 76 joining it to center crank 58. Cam 104 and ratchet member 76 are thereby rotated counter-clockwise with center crank 58 until pawl trip pin 102 disengages opening pawl 80 upon rotating center crank 58 to its fully open position. At this time torsion spring 106 returns valve operating cam 104 and ratchet member 76 to their neutral positions. When center crank 58 is rotated clockwise from its fully open position, closing pawl 84 immediately engages ratchet member 76. Valve operating cam 104 and ratchet member 76 are rotated clockwise with center crank 58 until pawl trip pin 102 disengages closing pawl 84, whereupon torsion spring 106 again returns valve operating cam 104 and ratchet member 76 to their neutral positions.

Cam follower assembly 52 includes a pivot arm 112 pivotal about a pivot shaft 114 carried by the mechanism supporting structure. A cam follower 116 is mounted on one end of pivot arm 112 for rolling engagement on the periphery of valve actuating cam 104. One end of a connecting link 118 is pivotally connected to the opposite end of pivot arm 112 by a pivot pin 120. The opposite end of the connecting link 118 is pivotally connected to an adjacent end of valve actuating rod 40 via a pivot pin 122. Valve closing spring 42 exerts a force which is transmitted through valve actuating rod 40, connecting link 118, and pivot arm 112, to maintain cam follower 116 in contact with the periphery of valve operating cam 104. The periphery of the cam 104 is shaped such that the high pressure gas valve 38 is fully closed only when valve operating cam 104 is disposed in its neutral position. Consequently, valve closing spring 42 acts in conjunction with torsion spring 106 to return and maintain valve operating cam 104 and ratchet member 76 in their neutral positions if neither of pawls 80, 84 is engaged with corresponding ratchet teeth.

FIG. 5 shows the position of various elements of circuit interrupter operating mechanism 44 when circuit interrupter 2 is closed, as illustrated in FIG. 1. Each pair of closed interrupter breaker contacts 12 and 20, 14 and 22, is spring-loaded to exert a force against each contact operating shaft 24, 26 and position the inner end of the elongated opening 72, 74 of each contact operating shaft 24, 26 against a respective pivot pin 68, 70 extending therethrough. Torsion spring 106 is in its unloaded, neutral position. Valve operating cam 104 and ratchet member 76 are in their neutral positions, and are maintained in such position by the force exerted by valve closing spring 42 on valve operating cam 104 through cam follower assembly 52. Opening pawl 80 is held in contact with one of ratchet teeth 78 by its associated torsion spring 88, while the free end of closing pawl 84 is held against pawl trip pin 102 by associated torsion spring 96 positioning closing pawl 84 out of engagement with ratchet member 76.

Figure 6:
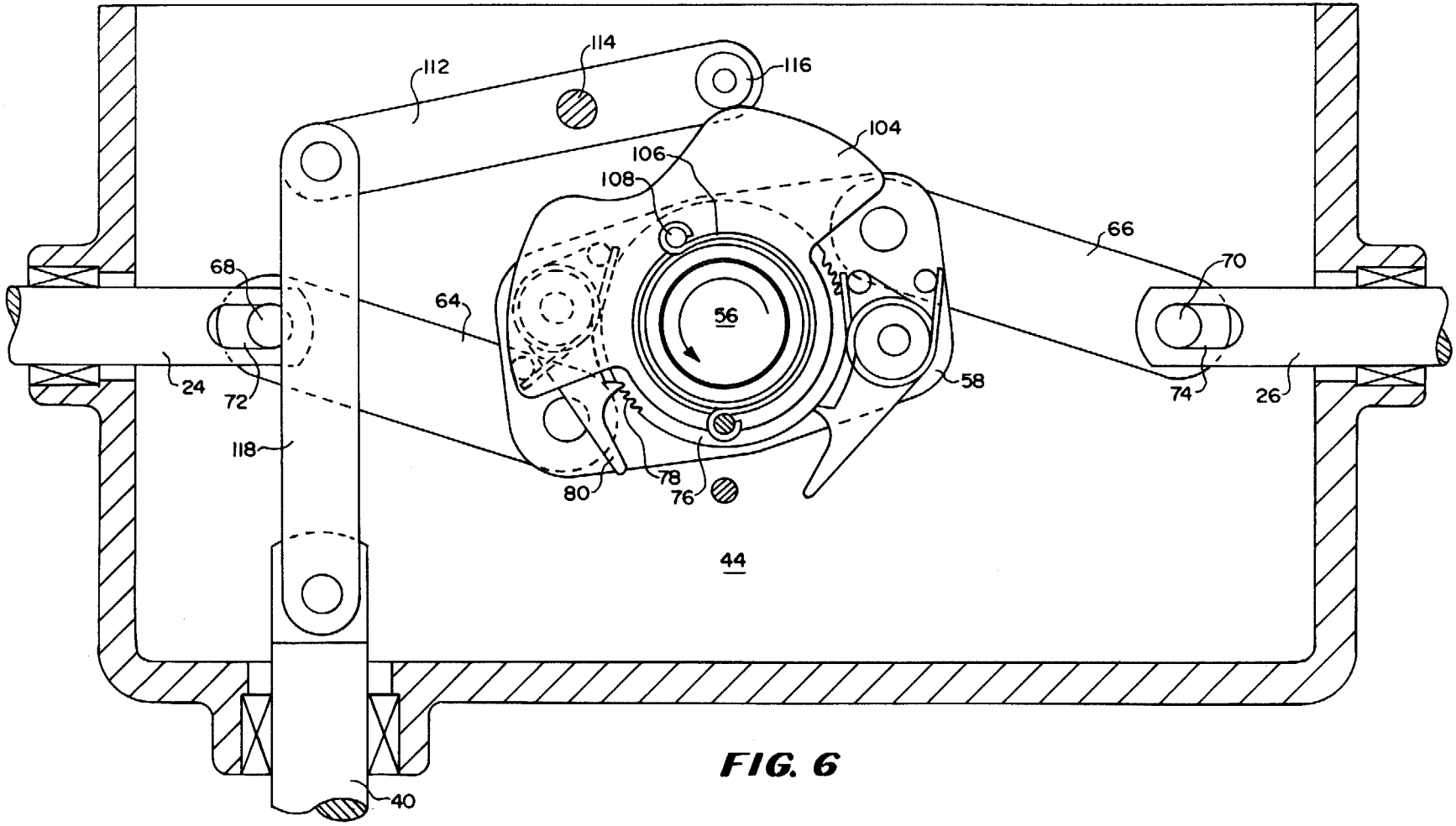

During an opening operation, center drive shaft 56 is rotated in a counter-clockwise direction from its fully closed position to its fully open position. When counter-clockwise rotation of the center drive shaft 56 and the center crank member 58 attached to it, is initiated, opening pawal 80 immediately engages one of ratchet teeth 78 to rotate ratchet member 76 and valve operating cam 104 in a counter-clockwise direction along with the center crank member 58. Such movement is against the force exhibited by torsion spring 106, which is charged in one direction as the end of the spring 106 held by spring retaining pin 108 to valve operating cam 104, is rotated counter-clockwise from its neutral position. As valve operating cam 104 is rotated in a counter-clockwise direction, it acts against cam follower 116 to cause pivot arm 112 to rotate about its pivot shaft 114 in a counter-clockwise direction. This movement in turn actuates valve actuating rod 40, connected to the opposite end of pivotal arm 112 via connecting link 118, to initiate opening of the high pressure gas valve 38. The high pressure gas valve 38 is fully opened to allow high pressure gas to be admitted to plenums 34, 36 surrounding interrupter modules 4, 6, before any movement of the breaker contact 20, 22 occurs. The position of the various operating mechanism elements during the rotation of the center drive shaft in a counter-clockwise direction just prior to the opening of breaker contacts 12 and 20, 14 and 22 is illustrated in FIG. 6. Toggle connecting links 64, 66, are retracted during the initial movement of center drive shaft 56, but no motion of the contact operating shafts 24, 26 occurs until each of pivot pins 68 and 70, coupling a respective toggle-connecting link 64, 66, to its associated contact operating shaft 24, 26, traverses the length of respective elongated slot 72, 74, through which pivot pins 68, 70, extend.

Figure 7:
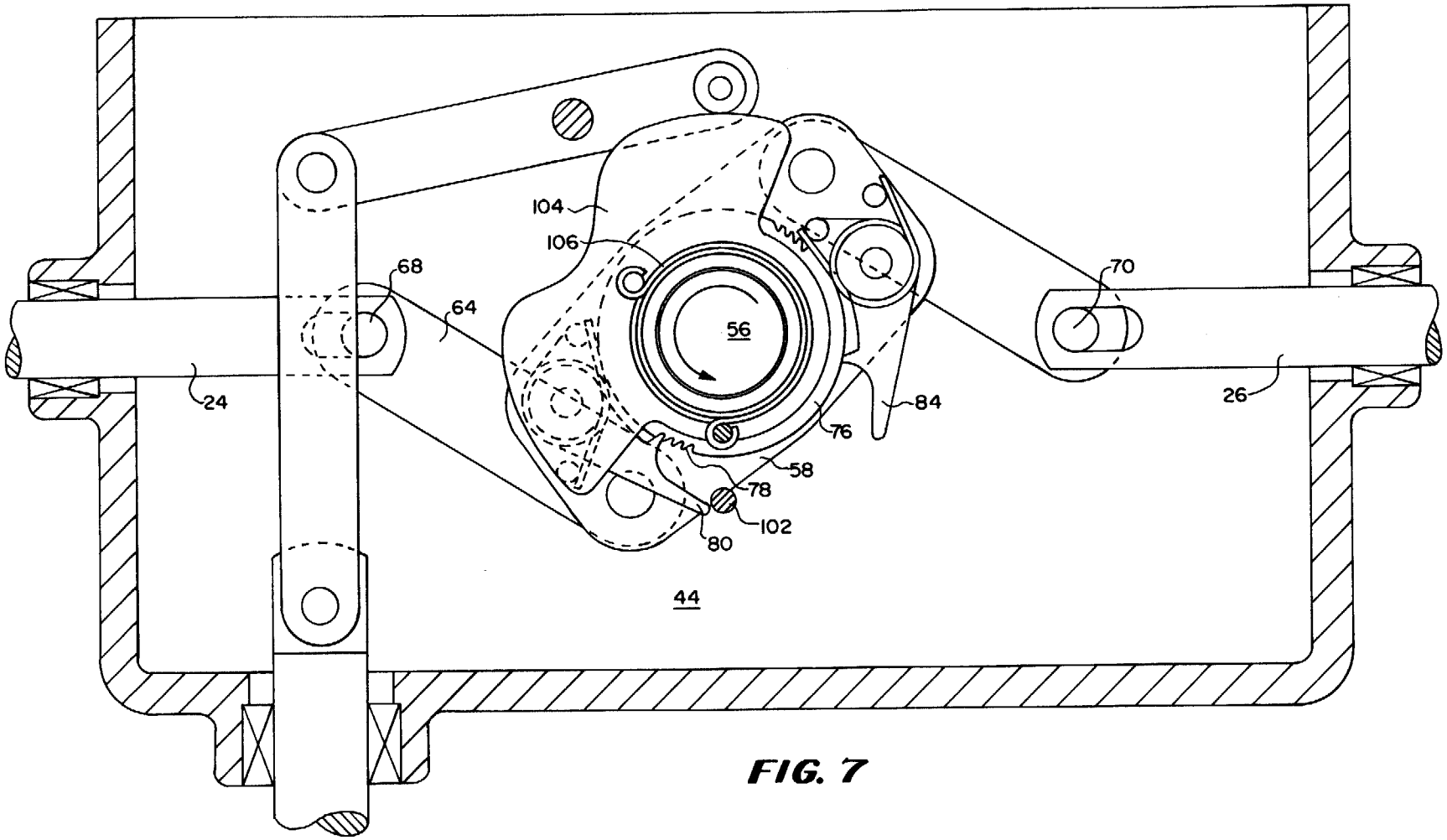
Figure 8:
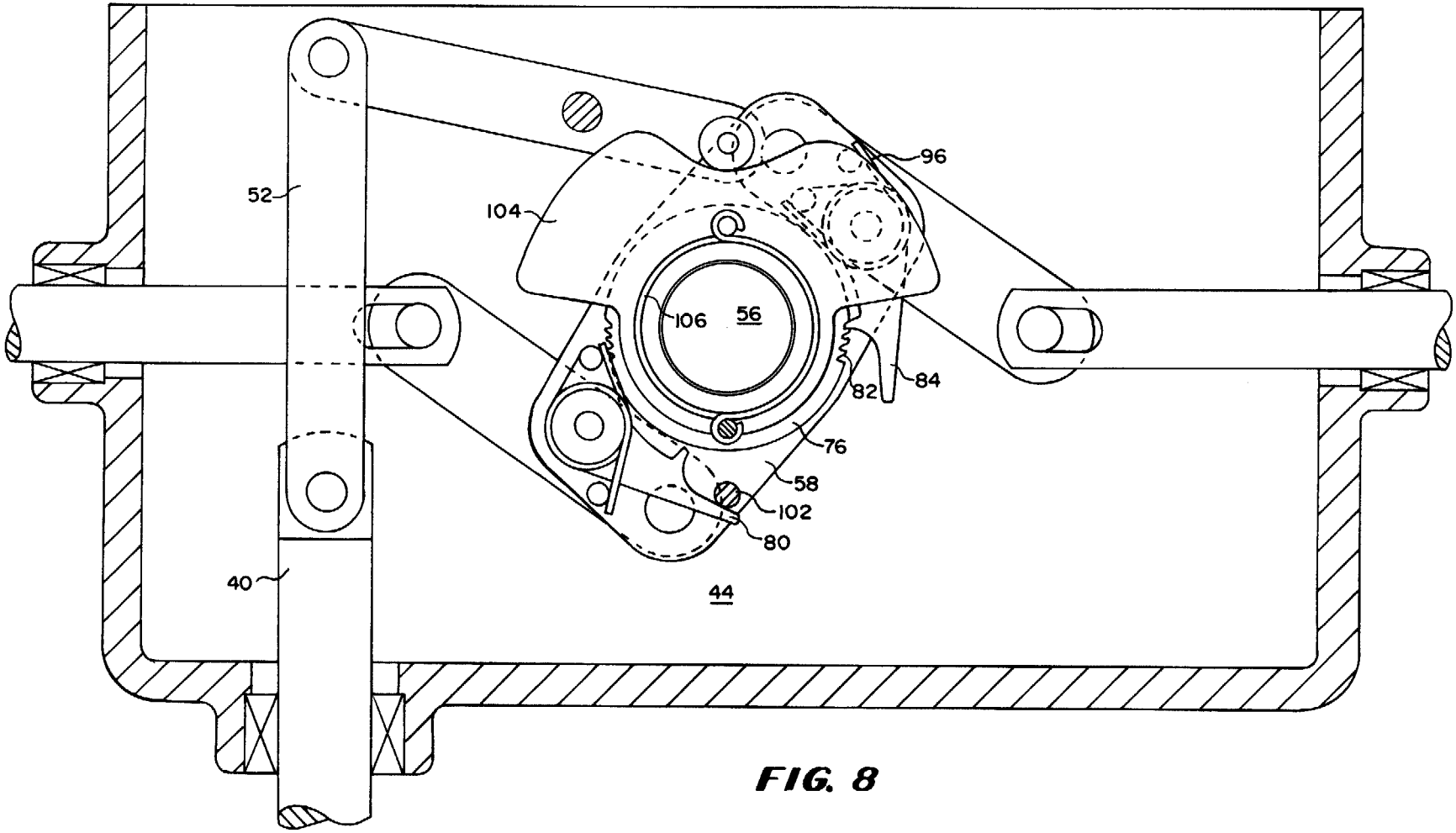

Further rotation of center drive shaft 56 in a counter-clockwise direction causes movable contacts 20, 22, to part from their associated stationary contacts 12, 14. The arc drawn between each pair of separating contacts 12 and 20, 14 and 22, respectively, is cooled by the flow of pressurized gas from the high pressure gas reservoir 30 through valve 38, plenums 34, 36, and the open contacts of each interrupting module 4, 6, into low pressure gas reservoir 32, as illustrated in FIG. 2. High pressure gas valve 38 is held open by valve operating cam 104 during further rotation of center drive shaft 56 until arcs drawn between the open contacts 12 and 20, 14 and 22, respectively, have been extinguished and center crank member 58 has been rotated in a counter-clockwise direction, almost to its fully open position. The latter is illustrated in FIG. 7, showing the position of the various elements of the operating mechanism just prior to the free end of opening pawl 80 making contact with stationary pawl trip pin 102. In this position, closing pawl 84 is in sliding contact with the ratchet member 76. Opening pawl 80 remains in engagement with one of ratchet teeth 78, and torsion spring 106 is nearly completely charged. When center drive shaft 56 is rotated beyond the position shown in FIG. 7 to its fully open position, the free end of opening pawl 80 rides up and over pawl trip pin 102, causing opening pawl 80 to be disengaged from ratchet member 76, and allowing the fully charged torsion spring to rotate valve operating cam 104 and ratchet member 76 in a clockwise direction toward its neutral position. When ratchet mechanism 76 is returned to its neutral position and center crank 58 is in its fully open position, as illustrated in FIG. 8, closing pawl 84 is positioned in engagement with one of ratchet teeth 82 of the ratchet member.

Figure 9:
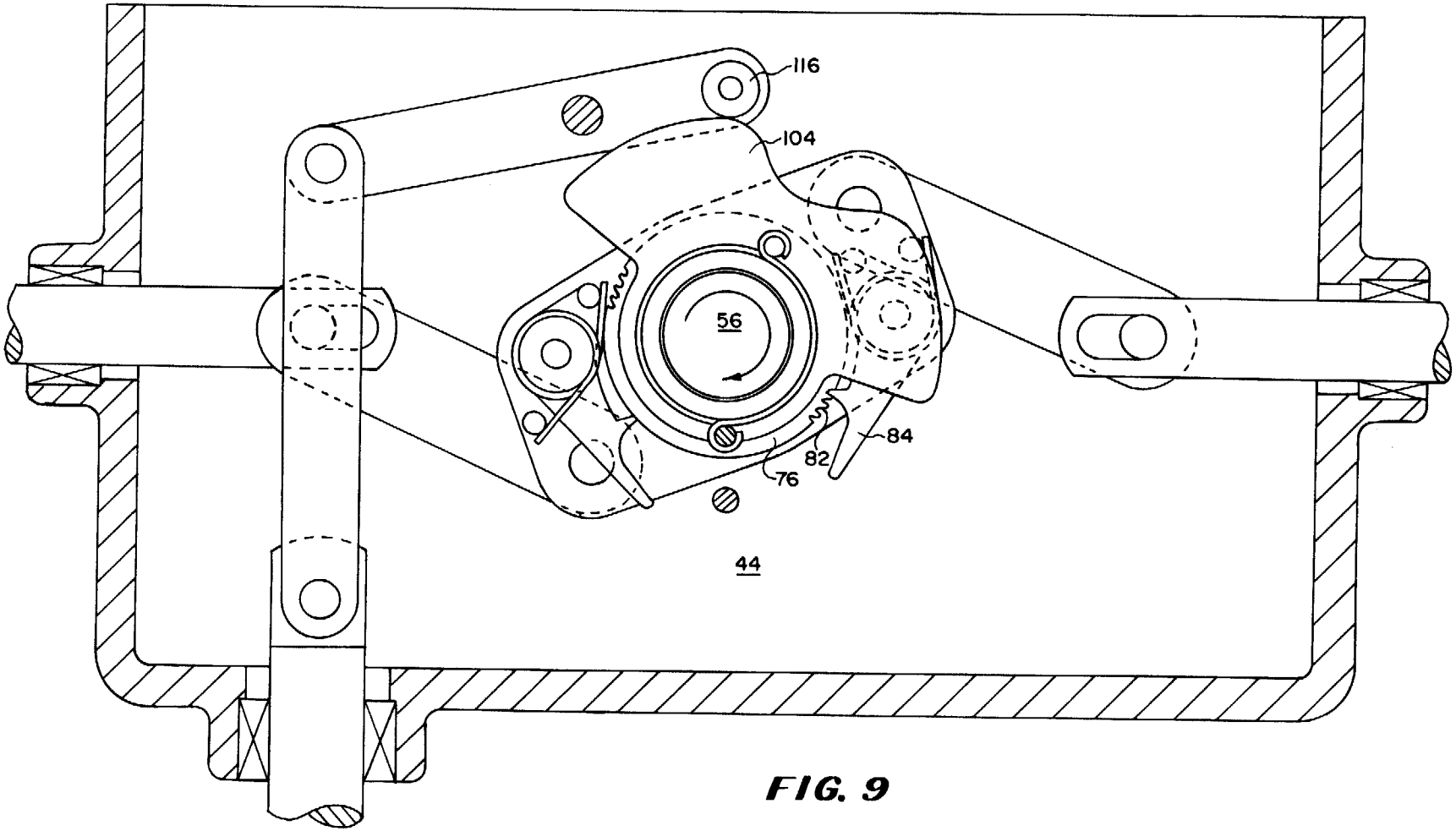
Figure 10:
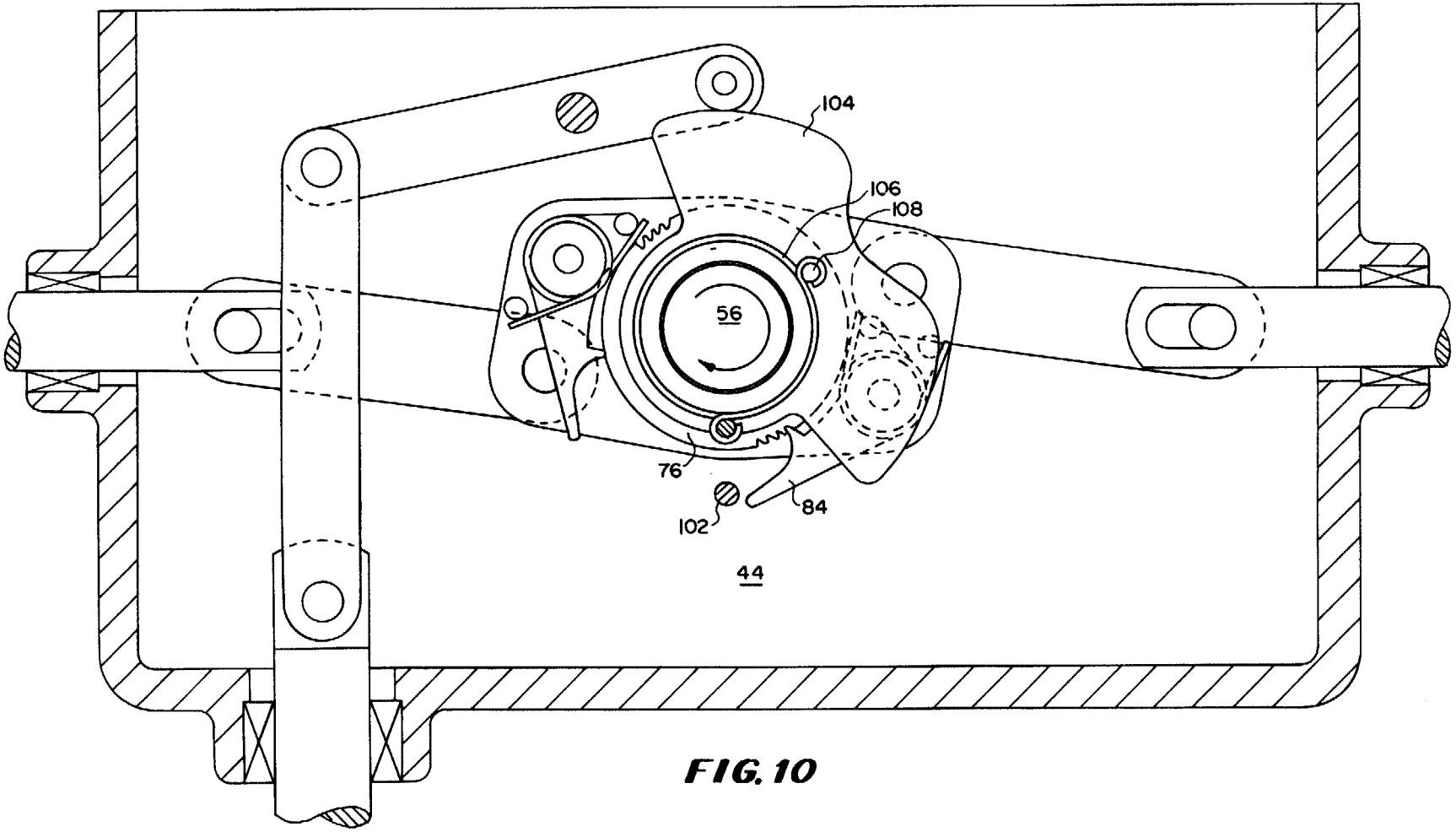

During a closing operation of circuit interrupter 2, center drive shaft 56 is rotated in a clockwise direction from its fully open position to its fully closed position. Upon initiation of clockwise rotation of center drive shaft 56, closing ratchet 84 immediately engages one of ratchet teeth 82 of ratchet member 76, thereby causing ratchet member 76 and valve operating cam 104 to be rotated in a clockwise direction by the center drive shaft, as shown in FIG. 9. Again, valve operating cam 104 acts on cam follower 116, causing high pressure valve 38 to fully open so high pressure gas is permitted to flow between the still open contacts 12 and 20, 14 and 22, respectively, thus preventing prestrikes before movable contacts 20, 22 engage respective stationary contacts 12, 14. The high pressure valve is held in its fully open position by valve operating cam 104 during further clockwise rotation of center drive shaft 56 until both sets of contacts 12 and 20, 14 and 22, respectively, are fully closed. The latter is illustrated in FIG. 10. Further rotation of the center drive shaft causes the free end of the closing pawl 84 to ride up and over stationary pawl trip pin 102, disengaging closing pawl 84 from ratchet member 76 and allowing the fully charge torsion spring 106 to quickly return ratchet member 76 and valve operating cam 104 to a neutral position. The latter movement permits valve closing spring 42 to close the high pressure gas valve 38, as illustrated in FIG. 5.

Various changes and modifications of the invention described herein may be made without departing from the spirit and scope of the invention. For example, cam-ratchet assembly 50 could be modified for movement along a straight-line path rather than an arcuate path. The latter can be accomplished by pivotally mounting opening and closing pawls 80, 84 to one of the contact operating shafts 24, 26, rather than to the drive shaft 56, and providing guide elements for slidably supporting the modified cam-ratchet assembly along its straight-line path of travel. Therefore, it is intended that the scope of this invention be limited only by the appended claims.

What is claimed is:

1. A fluid blast circuit interrupter for an electric power circuit, comprising;

at least one pair of separable circuit interrupting contacts, one of said contacts being movable relative to the other contact between a closed position, in engagement with said other contact to allow current to flow therebetween, and an open position, disengaged from said other contact to discontinue current flow therebetween;

interrupter operating means comprising a drive shaft, rotatable in first and second opposite directions and crank means mounted on said drive shaft for rotation therewith, said interrupter operating means coupled to said movable contact for moving said movable contact into and out of engagement with said other contact in accordance with predetermined rotation of said drive shaft, said interrupter operating means being movable between a closed position for closing said interrupter contacts and a first open position for opening said interrupter contacts;

a reservoir of high pressure, arc-quenching fluid;

plenum means, disposed between said reservoir and said pair of interrupting contacts for directing a flow of high pressure, arc-quenching fluid across an arc established between said contacts during an operation of said circuit interrupter;

a high pressure fluid valve disposed between said reservoir and said plenum means, and movable from a closed position to an open position for passing high pressure arc-quenching fluid from said reservoir into said plenum means;

means for activating said high pressure fluid valve;

valve coupling means for coupling said high pressure fluid valve to said valve actuating means;

said valve actuating means comprising cam means mounted on said drive shaft for rotation thereabout and being rotatable in said first direction along a predetermined path of travel to move said valve actuating means from a normally closed position to at least one open position, for opening said high pressure fluid valve and in said second direction along said predetermined path of travel to move said valve actuating means from said open position to said closed position for closing said high pressure fluid valve;

positioning means coupled to said valve actuating means for urging said valve actuating means toward its closed position;

opening latch means for coupling said cam means to said crank means when said valve actuating means and said interrupter operating means are in closed positions and upon initiation of movement of said interrupter operating means from it's closed position toward it's open position, said cam means being rotated with said crank means in said first direction to move said valve actuating means from it's closed position to its first open position against the force exerted on said valve actuating means by said positioning means, thereby to open said high pressure fluid valve in a predetermined manner; and opening latch release means for disengaging said opening latch means when said cam means is rotated with said crank means during an interrupter opening operation to move said interrupter operating means to its first open position, thereby to allow said positioning means to rotate said cam means about said drive shaft in said second direction to return said valve actuating means to its closed position.

2. A fluid blast circuit interrupter, as described in claim 1, wherein; said cam has a predeterminedly shaped cam surface;

said valve coupling means includes a cam follower positioned in contacting engagement with said cam surface, said cam follower being movable along a path of travel defined by said cam surface as said valve actuating means is moved toward and away from its closed position, to close or open said valve, respectively, said cam surface being shaped to close said valve when said valve actuating means is moved to its closed position, and to open said valve upon movement of said valve actuating means away from its closed position toward its first open position.

3. A fluid blast circuit interrupter, as described in claim 2, further including a cam follower positioning means for maintaining said cam follower in contacting arrangement with said cam surface, and wherein said cam follower positioning means comprises a valve closing spring for exerting a force on said valve and said cam follower in the closing direction of said valve.

4. A fluid blast circuit interrupter, as described in claim 3, wherein said positioning means includes;

torsion spring means for exerting a force on said valve actuating means when said cam means is in a position along its path of travel other than its closed position, for returning said valve actuating means to its closed position; and wherein said valve closing spring, exerts a return force on said valve to move said valve to its closed position whenever said valve is disposed intermediate its open and closed positions.

5. A fluid blast circuit interrupter, as described in claim 1, wherein said cam means includes a ratchet surface, and said opening latch means comprises:

an opening pawl, pivotally mounted on said crank means; and an opening pawl torsion spring, disposed between said opening pawl and said crank means and exerting a force on said opening pawl for urging said opening pawl into engagement with said ratchet surface of said cam means;

said ratchet surface defining at least one ratchet tooth positioned adjacent said pawl when said valve actuating means and said interrupter operating means are disposed in their respective closed positions, to engage said opening pawl when said interrupter operating means is moved from its closed position towards its open position during an interrupter opening operation.

6. A fluid blast circuit interrupter as described in claim 1, wherein said cam means is rotatable in said second direction opposite from said first direction along its path of travel to move said valve actuating means from its closed position toward a second open position, for opening said valve, and wherein said circuit interrupter further comprises:

closing latch means for coupling said cam means to said crank means when said valve actuating means is in its normally closed position and said interrupter operating means is in its open position, upon initiation of movement of said interrupter operating means from its open position toward its closed position, whereby said valve actuating means is moved with said interrupter operating means from its closed position to its second open position against the force exerted on said valve actuating means by said positioning means, thereby to open said high pressure fluid valve in a predetermined manner; and closing latch release means for disengaging said closing latch means when said cam means is rotated with said crank means during an interrupter closing operation, thereby to allow said positioning means to return said valve actuating means to its closed position.

7. A fluid blast circuit interrupter, as described in claim 6, further including a cam follower positioning means for maintaining said cam follower in contacting engagement with said cam, and wherein said cam means follower positioning means comprises a valve closing spring for exerting a force on said valve and said cam follower in the closing direction of said valve, thereby to maintain said cam means follower against said cam surface of said cam means of said valve actuating means.

8. A fluid blast circuit interrupter, as described in claim 6, wherein said positioning means includes;

torsion spring means for exerting a force on said cam means when said valve actuating means is in a position along its path of travel other than its closed position, for returning said valve actuating means to its closed position; and wherein said valve closing spring exerts a return force on said valve to move said valve to its closed position whenever said valve is disposed intermediate its open and closed positions.

9. A fluid blast circuit interrupter, as described in claim 6, wherein said cam means defines a ratchet surface, and said opening latch means comprises an opening pawl, pivotally mounted on said interrupter operating means; and an opening pawl torsion spring, disposed between said opening pawl and said crank means and exerting a force on said opening pawl for urging said opening pawl into engagement with said ratchet surface of said cam means;

said ratchet surface defining at least one ratchet tooth positioned adjacent to said opening pawl when said valve actuating means and said interrupter operating means are disposed in their respective closed positions, to engage said opening pawl when said interrupter operating means is moved from its closed position towards its open position during an interrupter opening operation.

10. A fluid blast circuit interrupter, as described in claim 9, wherein said closing latch means comprises:

a closing pawl pivotally mounted on said means;

a closing pawl torsion spring, disposed between said closing pawl and said crank means and exerting a force on said closing pawl for urging said closing pawl into engagement with said ratchet surface of said valve actuating means;

said ratchet surface defining at least one ratchet tooth positioned adjacent to said closing pawl when said interrupter operating means is disposed in its open position and said valve actuating means is disposed in its closed position, to engage said closing pawl when said interrupter operating means is moved from its open position towards its closed position during an interrupter closing operation.

11. A fluid blast circuit interrupter, as described in claim 6, wherein said cam means has a predeterminedly shaped cam surface;

said valve coupling means includes a cam follower and a cam follower positioning means for maintaining said cam follower in contacting engagement with said cam surface of said cam means of said valve actuating means, said cam follower being movable along a path of travel defined by said cam surface as said cam means is rotated about said drive shaft to move said valve actuating means toward and away from it's closed position to close and open said valve, respectively;

said cam surface being shaped to close said valve when said valve actuating means is moved to its closed position, and to open said valve upon movement of said cam means about said drive shaft, to move said valve actuating means away from its closed position toward a respective open position; and said cam follower positioning means comprises a valve closing spring for exerting a force on said valve and said cam follower in the closing direction of said valve to maintain said cam follower against said cam surface of said cam means of said valve actuating means;

said valve closing spring exerting a return force on said cam means to rotate said cam means about said drive shaft to move said valve actuating means to its closed position whenever said valve is disposed inermediate its open and closed positions.

12. A fluid blast circuit interrupter, as described in claim 11, wherein said cam means defines a ratchet surface, and said opening and closing latch means comprise, respectively, an opening pawl, pivotally mounted on said drive shaft, an opening pawl torsion spring, disposed between said opening pawl and said drive shaft, for exerting a force on said opening pawl for engagement thereof with said ratchet surface of said cam means;

said ratchet surface of said cam means defining at least one opening ratchet tooth positioned adjacent to said opening pawl when said valve actuating means and said drive shaft are disposed in their respective closed positions, to engage said opening pawl when said drive shaft is rotated from said closed position towards said open position during an interrupter opening operation; and a closing pawl, pivotally mounted on said drive shaft;

a closing pawl torsion spring, disposed between said closing pawl and said drive shaft for exerting a force on said closing pawl for engagement thereof with said ratchet surface of said cam means;

said ratchet surface of said cam means, defining at least one closing ratchet tooth positioned adjacent to said closing pawl when said drive shaft is disposed in said open position and said valve actuating means is disposed in said closed position, to engage said closing pawl when said drive shaft is rotated from said open position toward said closed position during an interrupter closing operation.

13. A fluid blast circuit interrupter, as described in claim 12, wherein said opening latch release means and said closing latch release means comprise, respectively, a stationary pawl trip pin;

wherein said opening pawl includes a predeterminedly shaped end surface for sliding engagement with said stationary pawl trip pin for rotation of said opening pawl out of engagement with said opening ratchet tooth against the force exerted on said opening pawl by said opening pawl torsion spring, when said drive shaft is rotated to its open position; and wherein said closing pawl includes a predeterminedly shaped end surface for sliding engagement with said stationary pawl trip pin for rotation of said closing pawl out of engagement with said closing ratchet tooth against the force exerted on said closing pawl by said closing pawl torsion spring, when said drive shaft is rotated into its closed position.

* * * * *